United States Patent [19]

Kauffmann

[11] 4,348,026

[45] Sep. 7, 1982

[54] DISC GAME APPARATUS

[76] Inventor: Russell E. Kauffmann, 1604 Executive Ln., Glenview, Ill. 60025

[21] Appl. No.: 717,339

[22] Filed: Aug. 24, 1976

[51] Int. Cl.[3] ..... A63B 67/14

[52] U.S. Cl. ..... 273/126 R; 273/DIG. 31

[58] Field of Search ..... 273/108, 126 R, 111, 273/120 R, 120 A, 129 B, 129 E, 85 R, DIG. 31, 124 R, 127 B, 125 R, 178 B, 115, 176 H, 87 H, 87 R, 119 A; 46/1 L, 43; 272/1, 3

[56] References Cited

U.S. PATENT DOCUMENTS

| | | | |
|---|---|---|---|
| 663,522 | 12/1900 | Stokes, Jr. | 273/87 H |
| 1,350,384 | 8/1920 | Parker | 273/120 R |
| 1,979,431 | 11/1934 | Wupper | 273/87 R |
| 1,983,044 | 12/1934 | Maynard | 273/125 R |
| 2,207,550 | 7/1940 | Popper | 273/126 R |
| 2,248,596 | 7/1941 | Wilsey | 273/119 A |
| 2,606,028 | 8/1952 | Zion | 273/127 B |
| 2,863,666 | 12/1958 | Aronson | 273/108 |
| 3,534,961 | 10/1970 | Tiley | 273/176 H |
| 3,640,535 | 2/1972 | Gendler | 273/126 R |
| 3,871,650 | 3/1975 | Casey | 273/87 R |
| 3,892,412 | 7/1975 | Koo | 273/178 B |

FOREIGN PATENT DOCUMENTS

| | | | |
|---|---|---|---|
| 636377 | 4/1928 | France | 273/108 |
| 1134621 | 12/1956 | France | 273/108 |
| 380575 | 9/1932 | United Kingdom | 272/1 R |

*Primary Examiner*—Richard C. Pinkham
*Assistant Examiner*—T. Brown
*Attorney, Agent, or Firm*—Richard G. Kinney

[57] ABSTRACT

A game apparatus of the table level type wherein projectiles, e.g., pucks or discs, are hand-propelled to slide over an elongated surface from a launch area to a target area, is disclosed, which employs an elongated slide surface which is formed into a fixed contour so as to present the sliding projectile, as it travels along the length of the slide surface, with surfaces of varying pitches.

6 Claims, 8 Drawing Figures

DISC GAME APPARATUS

FIELD OF THE INVENTION

The present invention relates to game apparatus and more particularly table height game apparatus of the type wherein a slider, such as a disc or puck, is hand-propelled to slide along an elongated surface from a launch area to a target area. One example of this type of game apparatus is table shuffleboard.

BACKGROUND OF THE INVENTION

Table level games involving the skillful hand sliding of a projectile disc or puck have achieved popularity as amusement devices and are commonly available in coin operated versions in public amusement places as well as for home recreational use. Table level shuffleboard is one of the more popular of this class of game. While some table surface games, for example as shown in U.S. Pat. No. 1,731,353, have in the past, introduced a continuous curving top surface for a spinning top and other games, e.g., those shown in U.S. Pat. Nos. 1,906,025; 2,900,189; provide shallow elongated throughs for sliding a puck; and still another, U.S. Pat. No. 3,482,837 introduced a flexible deformable surface for a rolling disc, the vast majority of the shuffle board games have taken pains to provide, and often provide adjusting apparatus for the insuring of, a true horizontal and flatness to the sliding surface.

SUMMARY OF THE INVENTION

The present invention is directed to a more challenging game apparatus of the type wherein projectiles, discs or pucks, are hand-propelled to slide over an elongated upper surface from a launch area to a target area and wherein instead of providing a flat surface or a longitudinal channelled surface, a non-flexible sliding surface is provided which is contoured to as to present the sliding projectile as it travels along the length of the slide surface with successive surface areas of smoothly varying pitches.

This arrangement requires the player to more skillfully control his aim and speed so as to adjust to the undulating contour surface.

BRIEF DESCRIPTION OF THE DRAWING

In the accompanying drawing, like numerals refer to like elements, and.

DETAILED DESCRIPTION

Figure 1:
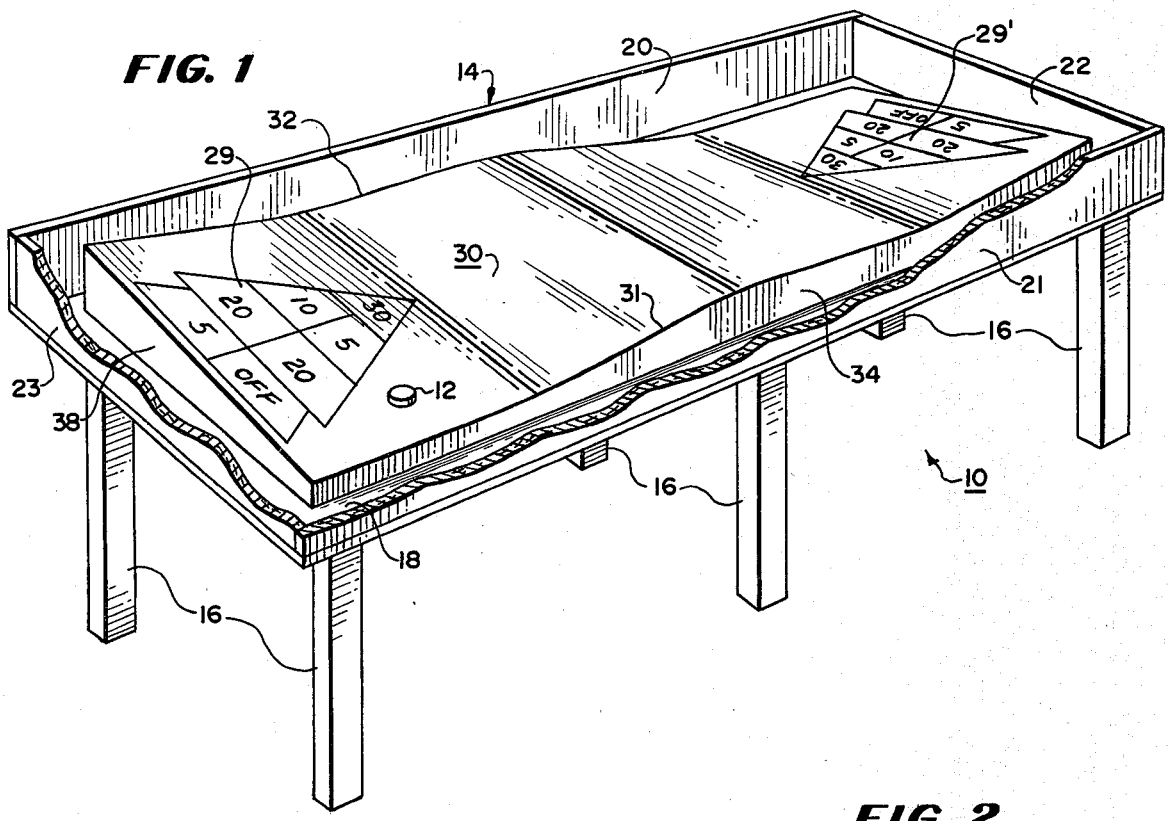
FIG. 1 is a perspective view of a game apparatus constructed in accordance with the present invention.

Referring to the drawings and especially FIG. 1 thereof, there is depicted a game apparatus 10 which incorporates the principles of the present invention. The apparatus 10 is of the countertop or table height type, by which is meant a height which enables a player to stand adjacent to the apparatus and to hand propel a slider such as the disc or puck 12 by moving and releasing it on the surface so that it will glide or slide after being released from a launch area to a target area.

Figure 2:
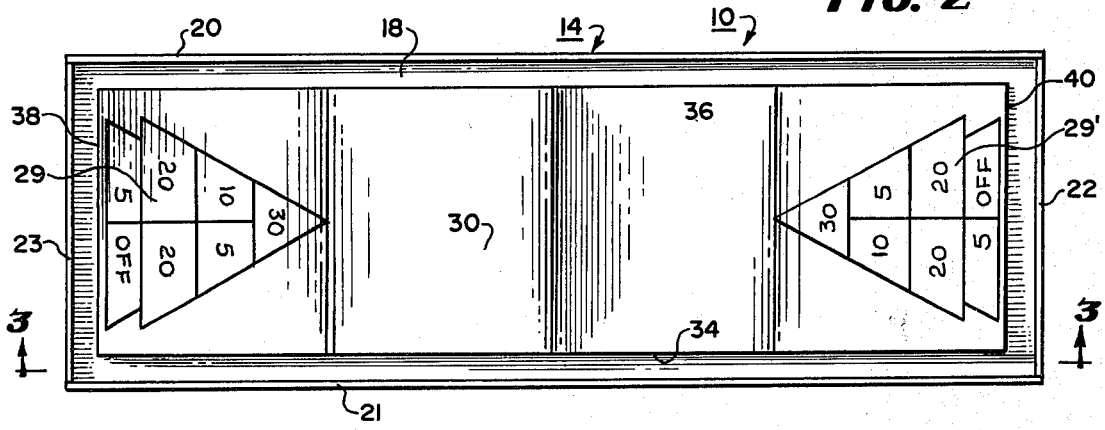
FIG. 2 is a top view of the apparatus of FIG. 1.

The apparatus 10 includes an upper playing unit 14 supported on legs 16 at the desired height. As best seen in FIG. 2 the playing unit 14 includes an elongated, rectangular and horizontal base 18 about whose periphery are mounted walls 20, 21, 22, 23 which serve to contain the sliders such as the disc 12 on the playing unit. These periphery walls 20–23 include a pair of parallel side walls 20, 21 and two end walls 22, 23.

Above the base 18 and within the rectangular area bounded by the walls 20, 22 is a smooth and hard playing surface 30 which bears conventional shuffleboard indicia defining the launch/target areas 29, 29'. The areas 29, 29', of course, each serve as the launch area for one team and the target area for the other team. The surface 30, in accordance with the present invention, is fixed, that is, it is a non-flexible surface which is contoured in a regular manner so as to present a succession of smoothly flowing hills and valleys of a low pitch or slope, to a longitudinally traveling disc moving from a launch area to a target area.

Figure 3:
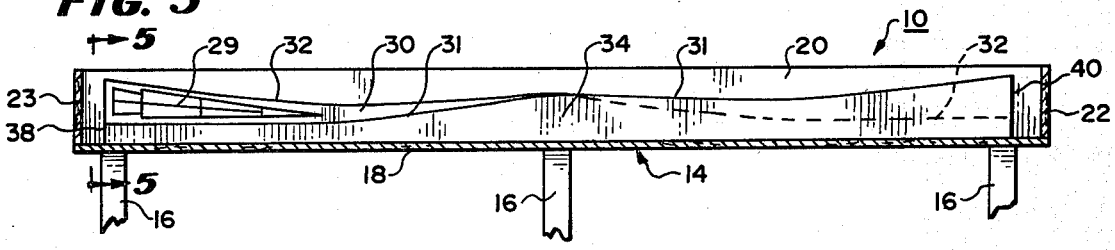
FIG. 3 is a side elevational view of the playing surface area of the apparatus of FIG. 2 (as seen partly in section and partly broken away), as seen from the line 3—3 of FIG. 2.
Figure 4:
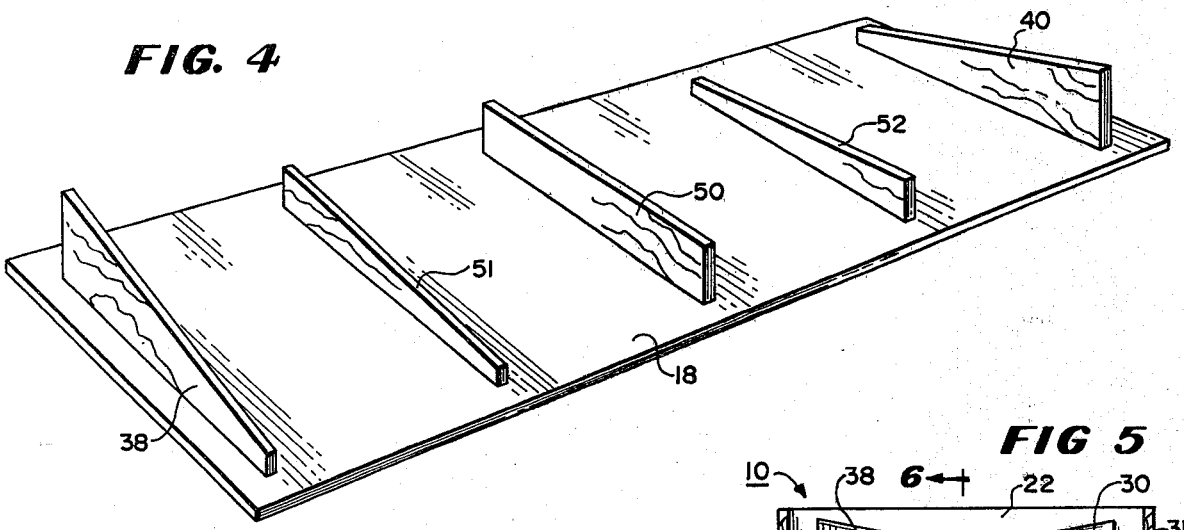
FIG. 4 is a perspective view of a subassembly of the apparatus of FIGS. 1–3, illustrating one manner of constructing the apparatus.
Figure 5:
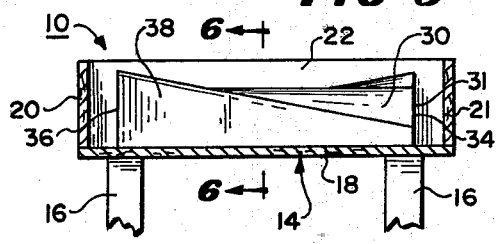
FIG. 5 is a sectional view of the apparatus of FIGS. 1 and 2 as seen from the line 5—5 of FIG. 3.

As best shown in FIG. 2 the surface 20 projects into a horizontal rectangle on the base 18 and is raised over that surface somewhat by side walls 34 and 36 (FIGS. 4–7) and end walls 38 and 40 (FIGS. 3 and 5). The raised surface 30 is spaced from the interior surfaces of walls 20–23 to form a "gutter" zone into which discs such as the disc 12 may fall.

As best seen in FIGS. 1 and 3, the intersections of the surface 30 and the side walls 32 and 34 are curves 31 and 32 which preferably are mirror images of one another.

In descriptive geometry germs, the surface 30 can be generated by moving a line segment parallel to the vertical plane along a pair of generally horizontal curving lines such as 31 and 32. The line segment in the disclosed embodiment is, as is preferred, a straight line segment (although a slightly curving line might be substituted to add a further element of complexity). It should be noted that the transverse pitch of the surface 30 is continuously varying as one moves in the longitudinal direction and changes from one direction (left to right in FIG. 1 at area 29) to another direction (right to left at area 29').

In play, the apparatus 10 is used in the same manner as a conventional table level shuffleboard game and the same rules may be followed. However, the ability of the player is tested more as he must adjust the speed and angle of launching his discs to overcome the effects of the varying pitch of the fixed contours of the surface 30. This requires an additional level of skill and this presents a greater challenge to the player.

Note should be taken that surface 30 of the apparatus 10 is symmetrical about its center point so that it presents the same contour when viewed from either end. Thus a team playing either end of the table is presented with the same surface configuration.

Figure 6:
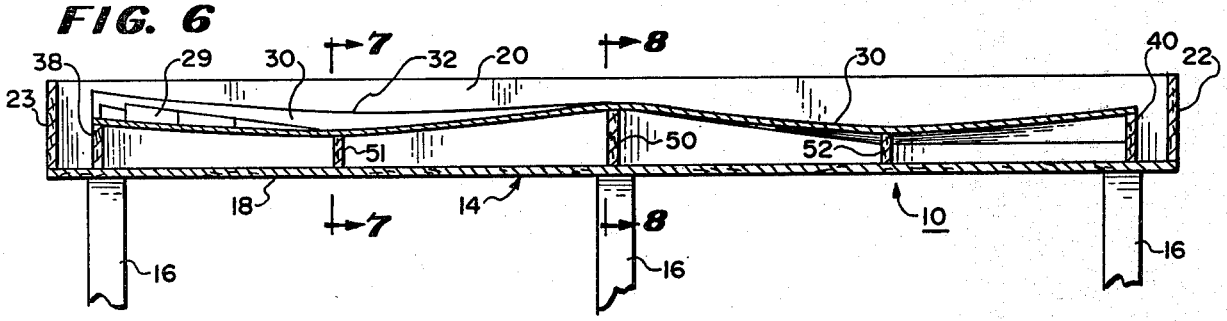
FIG. 6 is a sectional view of the apparatus of FIGS. 1–5 as seen from the line 6—6 of FIG. 5.
Figure 7:
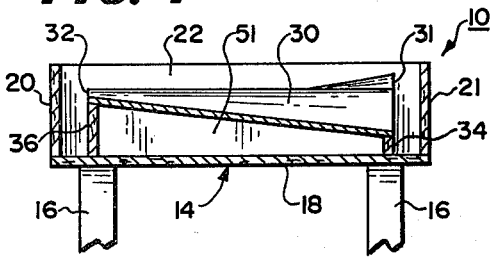
FIGS. 7 and 8 are each sectional views of the apparatus as seen from respectively the lines 7—7 and 8—8 of FIG. 6.
Figure 8:
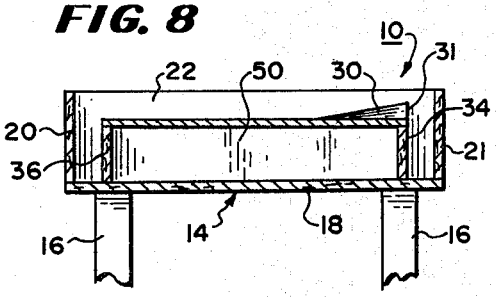

The surface 30 can be formed in a practical manner by first providing a pair of side walls 32, 34 of the shaped depicted and then providing end walls 38, 40 of the shape shown in FIGS. 4 and 5 and, to provide rigidity, a number of cross members such as central member 50 (FIGS. 4 and 7) and a pair of intermediate cross members 51, 52 (FIGS. 4 and 5 and FIGS. 4 and 6). (Note that each of the cross members 50, 51, 52, and end walls 38 and 40 have a straight line upper surface.)

A game apparatus similar to the described preferred embodiment was actually constructed and for concreteness of this disclosure but not for purposes of limitation of the invention dimensions of this particular unit will be detailed. In overall horizontal size this embodiment's surface 30 measured eight feet by two feet with the units 38, 51, 50, 52 and 40 being two feet in length and being spaced, on centers, two feet apart along the length of the base 18. The units 38 and 40 had side end heights of 6¼ inch and 1½ inch, while the units 51 and 52 had end edge heights of 3½ and 1½ inches. The central unit 50 was 4 inches in height.

A preferred way of forming the mirror image units 34, 36 or 51, 52 or 38, 40 is to cut sandwiched pieces of plywood at the same time and to simply turn one end for end.

On this frame work a sheet of thin but stiff material, such as pressboard, can then be bent or deformed over the top surface and secured in any convenient manner, such as with mastic, to form the surface 30. It should be noted that such a sheet would not be, prior to forming, of a rectangular shape but would be irregular in outline. Of course, a larger than needed sheet could be used and the overlapping margins removed.

Alternatively, the surface 30 may be formed by any other convenient manner, for example, by using lightweight concrete (vermiculite agrigate) and a suitable reinforcing media (such as expanded mesh) in a suitably shaped form. Or reinformed plastic cast in forms, such as fiber glass as in the manner for making fiberglass boat hulls. Numberous other materials and construction techniques could also be substituted.

Although the present invention has been described in terms of a symmetrical table level shuffleboard game, at least in their broader aspects, the principles of the invention can be applied to other games that involve the sliding of a disc along an elongated surface such as the currently popular coin operated baseball (and like) shuffleboard games wherein the target area comprises sensors which are triggered by the disc.

Although a specific preferred embodiment has been disclosed in detail, the present invention can take many forms and it is the intention to claim the present invention in all of the aspects and, in at least the broader claims, with such a scope as to encompass the invention in such a manner as consistent with the contribution to this art.

For example, although as disclosed in the presently preferred embodiment the playing surface is completely surrounded with a gutter, the invention has been reduced to practice in a version which employs an upstanding sidewall adjacent the periphery of the playing surface and against which pucks may be deflected during play. It is therefore the intent of at least the broadest of the appended claims to also cover this variation as well as intermediate variations, such as would employ a gutter over a part of the periphery of the playing surface and a deflection wall over the remainder.

What is claimed is:

1. In a table-height game apparatus of the type wherein a slider is propelled to slide freely along an elongated, upward-facing smooth and hard surface from a launch area to a target area, the improvement comprising constructing the surface into a fixed inelastic contour such that a slider travelling along the surface from the launch area to the target area is presented, over at least a portion of its path, with successive surface areas having a progressively changing transverse pitch, which pitch smoothly varies from one direction to another and back to the first direction along the direction of travel of the slider.

2. The invention as defined in claim 1, wherein the game is of the type wherein sliders may be propelled from either end of the elongated surface and wherein said surface is symmetrical about its center so as to present the same contour to both ends and whose target and launch areas are at approximately the same height and which surface is considerably wider than the slider.

3. The invention of claim 2 wherein the game table is for the playing of shuffleboard and has a depressed gutter area surrounding the surface.

4. The invention as defined in claim 1 wherein the surface is a warped surface such as would be generated by a transverse line segment moved in the longitudinal direction of the surface such that it constantly touches two smoothly curving lines which curving lines are separated from each other and are not identical in shape.

5. The invention of claim 4, wherein the line segment is a straight line segment.

6. A game apparatus playing unit comprising: means defining a generally upward-facing, elongated, hard and smooth playing surface of a fixed contour such that over a significant proportion of its longitudinal extent the surface has a smoothly varying transverse pitch which pitch smoothly varies from left to right to right to left, said surface extending several feet in length; and means for defining longitudinally separated launch and target areas, such that a slider moving from the launch area to the target area may pass over the varying pitch fixed contour, and said apparatus is used with a disc-like slider whose width is small in comparison to the width of the surface.

* * * * *